US006161654A

United States Patent [19]

Sirigu et al.

[11] Patent Number: 6,161,654

[45] Date of Patent: Dec. 19, 2000

[54] VIRTUAL CAR OPERATING PANEL PROJECTION

[75] Inventors: Gerard Sirigu; Xavier Lejon, both of Gien, France

[73] Assignee: Otis Elevator Company, Farmington, Conn.

[21] Appl. No.: 09/311,813

[22] Filed: May 13, 1999

[30] Foreign Application Priority Data

Jun. 9, 1998 [FR] France ..... 98-072252

[51] Int. Cl.[7] ..... B66B 3/00

[52] U.S. Cl. ..... 187/391; 127/396; 127/395

[58] Field of Search ..... 187/391, 393, 187/395, 396, 397, 399, 388; 340/815.42, 815.79; 359/189, 144, 154

[56] References Cited

U.S. PATENT DOCUMENTS 4,577,177 3/1986 Marubashi ..... 340/19 R
4,623,869 11/1986 Marubashi ..... 340/19 R
5,398,783 3/1995 Jacoby ..... 187/395
5,485,897 1/1996 Matsumoto et al. ..... 187/399

FOREIGN PATENT DOCUMENTS 2-158571 6/1990 Japan .
3-259880 11/1991 Japan .

*Primary Examiner*—Jonathan Salata

[57] ABSTRACT

The invention concerns a device for displaying a virtual image, particularly of the control panel of an elevator cabin. The device includes a projector for projecting at least the virtual image of an elevator control panel from or near the cabin ceiling (13) onto a wall surface (9) of the cabin, in an appropriate position so that the virtual control elements (27) of the panel are recognized as such by the operator and by a control sensor for activating the control of the elevator in the classic manner.

9 Claims, 3 Drawing Sheets

FIG.3
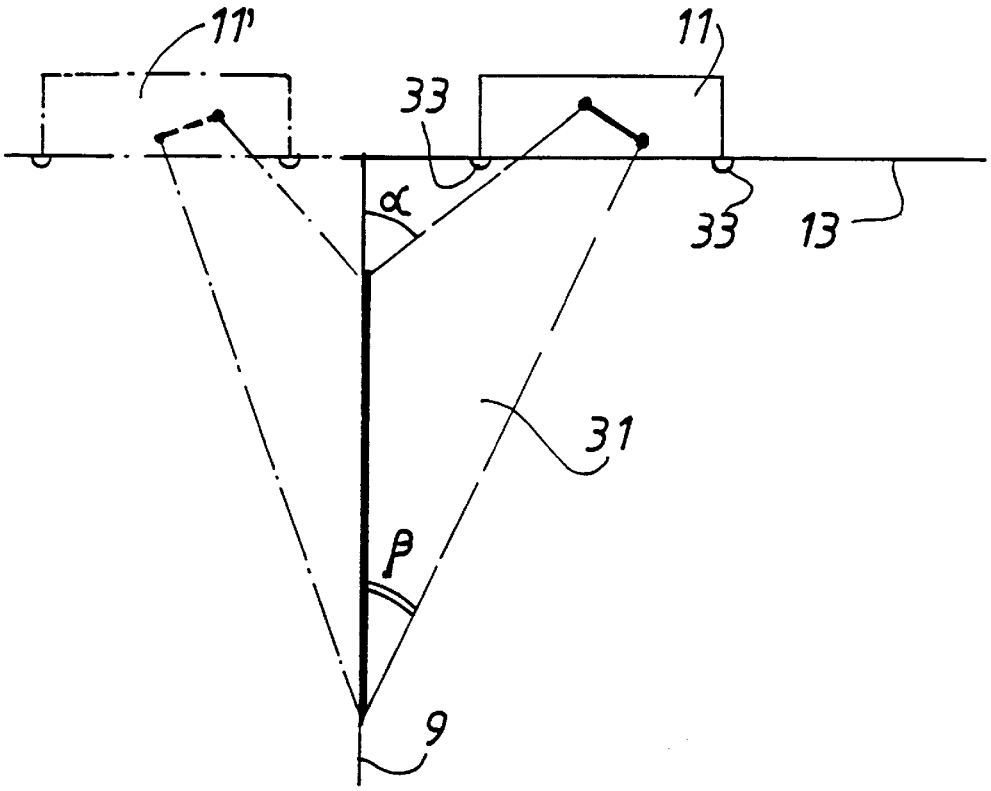
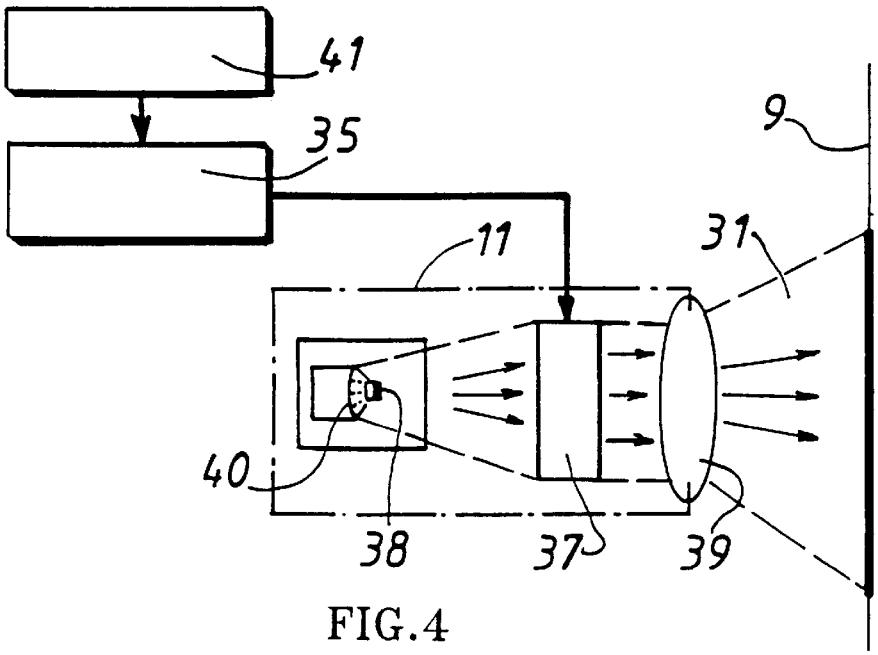
FIG.4

VIRTUAL CAR OPERATING PANEL PROJECTION

TECHNICAL FIELD

This invention concerns a method and a device for displaying a virtual image, particularly of an elevator cabin's control panel.

BACKGROUND OF THE INVENTION

It is known that current elevator control panels require installing an appropriately shaped control panel which uses various control buttons, on the wall of an elevator cabin. These panels are subject to mechanical wear of the buttons and require relatively large linkage cables. They are furthermore exposed to acts of vandalism.

DISCLOSURE OF THE INVENTION

The invention intends to remedy these drawbacks and proposes a method of displaying a virtual image, particularly of the control panel in an elevator cabin, characterized in that it consists at least of projecting the virtual image of an elevator control panel from or near the cabin ceiling onto a wall surface of the cabin in an appropriate position, where the virtual control panel elements are recognized as such by the operator and by a control detector to activate the elevator control in the classic manner.

The projection of the image is carried out to advantage from a part of the ceiling near said projection surface on the wall of the cabin, preferably near the upper edge of this wall. In this way the projection of the image beam does not risk being interfered with by a person or an object.

The projection of the image on said projection surface takes place to advantage by passing a light beam emitted by a light source through the flat screen of a transmission-type liquid crystal display and through a lens which collimates the beam on said projection surface.

The image on the liquid crystal display is controlled, at least for certain parts or windows of the control panel concerning, for example, the display of the floors, messages about the floors, or advertising, entertainment or publicity messages, by an adapted data processing means such as a microprocessor, computer, etc.

The control detector can be a camera or an analog optical detector, able to read the activation position of the control elements by the operator. It can also be an infrared touch pad, a resistive touch pad, an acoustic surface or guided wave plate, or a capacitive plate which forms a projection screen for the control elements of the control panel.

The invention thus includes a display device for a virtual image to perform the previously defined method, particularly the display of a control panel in an elevator cabin, characterized in that it includes projection means for a virtual image at least of the control panel of the cabin, positioned on or near the cabin ceiling and designed to project said image in an appropriate command position on a vertical wall of the cabin, and means of recognizing the virtual control elements of the image that can be activated by an operator for control of the elevator like a classic control panel.

BRIEF DESCRIPTION OF THE DRAWINGS

The invention is illustrated in the following by means of a configuration example and in reference to the attached drawings in which:

FIG. 3 is vertical cross section of the device of the invention inside the elevator cabin; and FIG. 4 is a functional block diagram of the device of the invention.

BEST MODE FOR CARRYING OUT THE INVENTION

Figure 1:
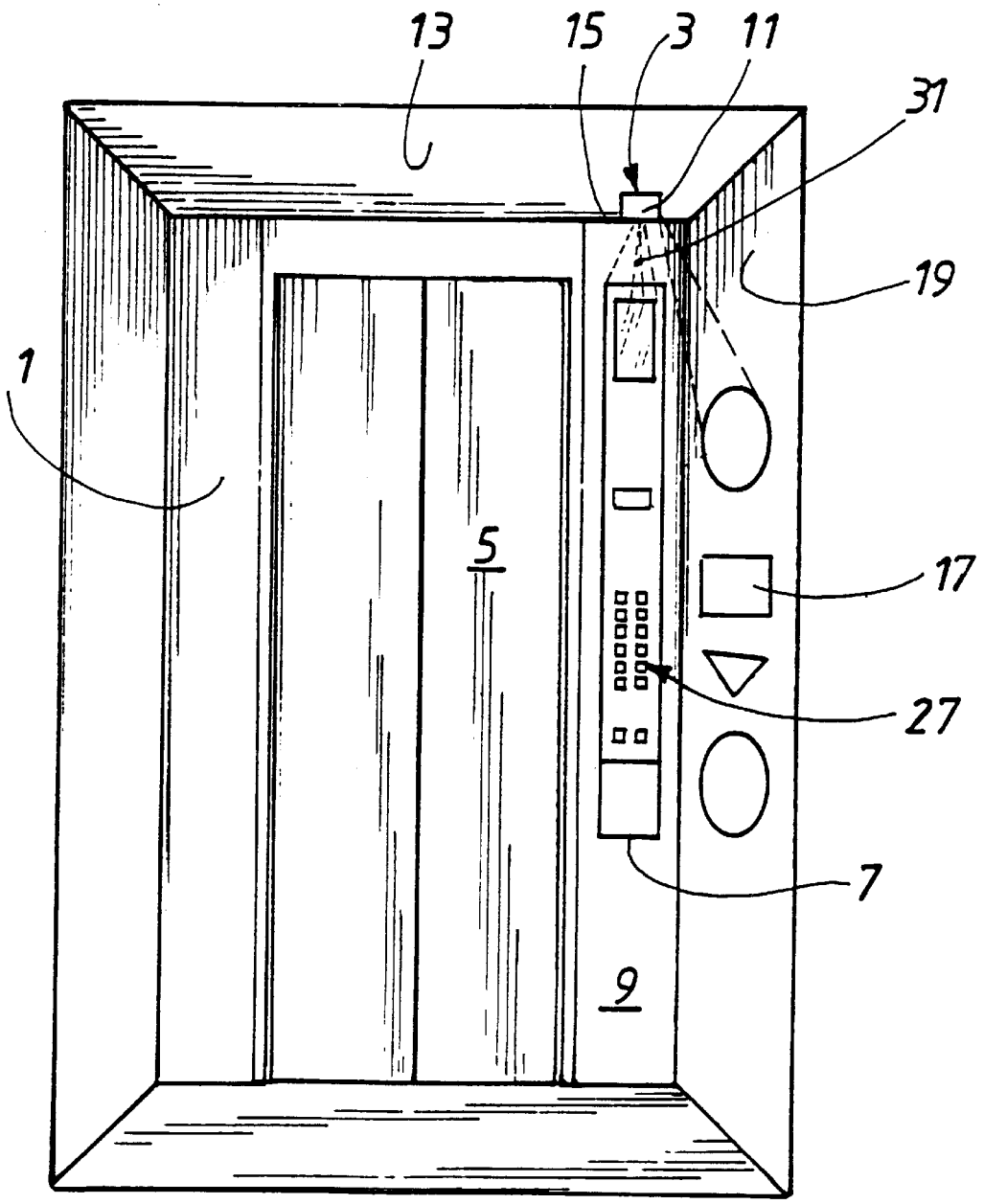
FIG. 1 is a perspective view of the inside of an elevator cabin equipped with a display device for a virtual image of the control panel according to the invention.

FIG. 1 is a view of the inside of an elevator cabin 1 equipped with the device 3 of the invention facing the opening and closing doors 5 of the cabin. The control panel 7 appears in an angle panel 9 near the doors 5, in the form of a virtual image projected from a light projection box 11 located in the ceiling 13 near the upper edge 15 of the angle panel. Another image 17, which is related to but independent of the control panel 7, is projected by the projection box 11 onto a main wall panel 19 of the cabin. The image of the control panel 7 is placed in an appropriate position for viewing and control by adult persons in the cabin, like a mounted, wired, prior art control panel. The surface of the angle panel 9 is preferably reflective in order to properly reflect the image projected from the upper projection box.

Figure 2:
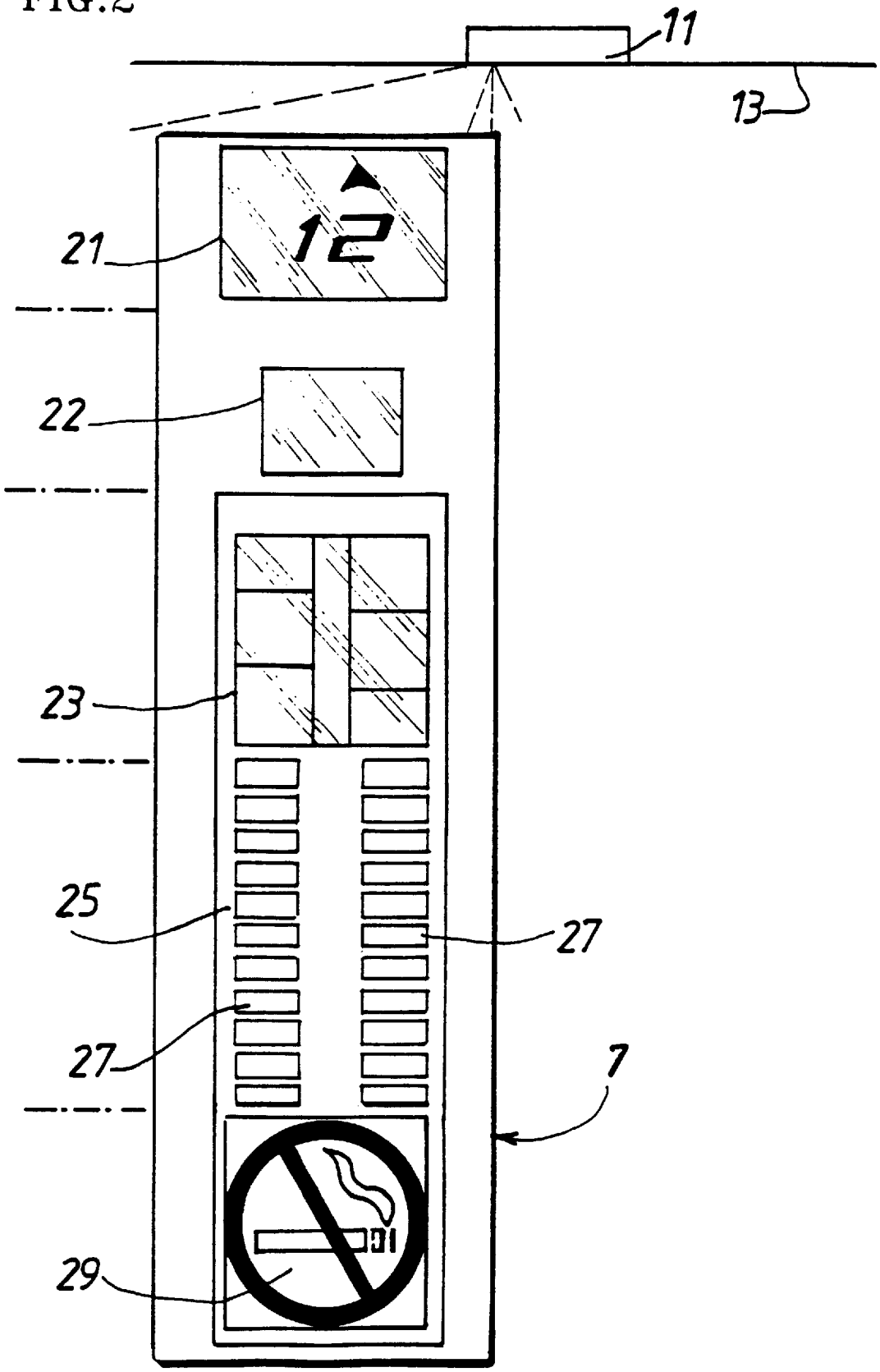
FIG. 2 is an enlarged view of the virtual image of the control panel projected by the device of the invention.

FIG. 2 is an enlarged view of the control panel 7, which appears in rectangular form with a long vertical side. This panel contains several windows, respectively from top to bottom a window 21 indicating the current floor and the cabin's direction of displacement, a window 22 visualizing the current floor landing near the hall door as seen by an outside camera, a window 23 showing the plan of the selected floor, a window 25 containing all the call and control buttons 27 of the cabin, and a window 29 which displays a message, for example a cabin regulation or an alarm condition. Only the window of the buttons 25 remains steady and constant; the other windows 21, 22, 23, 29 can vary as a function of the cabin's movement, its location and its operating condition. This window 25 can correspond to the location of a resistive touch pad on the panel, on which the various manual control elements, by means of a finger, are shown in visual form by the virtual projection of the buttons 27 (floor numbers). An operator wanting to give a command pushes a selected button 27 (visualized by the projection). The command itself is unchanged by comparison with an attached prior art control panel.

FIG. 3 is a vertical cross section of the image beam 31 projected in the upper comer of the cabin. This projection takes place from the projection box 11 on the ceiling, and according to a projection angle relative to the panel its lower limits are $\beta$ and its upper limits are $\alpha$.

The projected image is in fact distorted, elongated or shortened in increasing or decreasing fashion along its length in order to appear normal on the projected panel.

The box 11 is preferably mounted on flexible joints 33, thus it is isolated from vibrations in order to provide a good image quality (good stability).

As shown by dots and dashes, the projection can be performed by a box 11' positioned outside of the cabin, for example placed symmetrically to the internal box 11 with respect to the projected panel 9, and projecting an image on a translucent window of the panel. This arrangement eliminates interfering reflections.

FIG. 4 illustrates an operating block diagram of the device of the invention, essentially showing the projection case 11, the image projection screen 9 in the cabin and the control and handling means 35 of the projection case. The projection case 11 includes a transmission-type liquid crystal display screen (LCD) 37, with an active or passive matrix which is monochromatic or colored. The projection principle is called a 'monovalve' and is well known in the art. A visible light beam, derived through rear-lighting (to prevent heating) passes through this screen, and passes through an integrating lens, an ultraviolet filter and a field lens (a known but not illustrated technique), obtained for example from a light source 38 and a so-called cold mirror 40, and is conducted to a projection lens or objective 39 for focusing the output of the projected image. The image is modulated by the LCD screen which is controlled by the processing unit 35, for example a type of microprocessor which itself receives external image data 41 corresponding to the nature of the desired image (control panel and others). The microprocessor 35 processes the LCD image in order to update all the windows 21–29 of the virtual control panel in real time as a function of the situation, of the condition and movement of the cabin, as indicated previously.

The overall image of the panel can potentially be changed by supplying image data to another module 41. Of course the forgoing description of the invention may include numerous variations.

Thus, the projection surfaces can either include a simple cabin panel, or a touch pad for acoustic surface waves with piezoelectric transducers, or an infrared touch pad, or a resistive touch pad, etc.

If the virtual image is projected onto a touch pad, it is easy to use a finger for the command selection by means of control electronics which provide the X and Y positions on the pad, as well as pressure information. A processing software then recognizes the selected floor or more generally the pressed button (door opening, specific maneuvers, etc.).

If the image is projected on a simple panel, the detection could be carried out by a camera and shape recognition software. The call can be validated for example by inverse video projection of the selected touch.

The projection surface can also have Braille characters for the blind.

In addition a projection on the back of the cabin could be imagined, using the LCD projection of the virtual control panel for anti-stress and anti-claustrophobia sensations.

Furthermore, images could also be projected onto the cabin wall, essentially along its height.

Various changes to the above description may be made without departing from the spirit and scope of the present invention as would be obvious to one of ordinary skill in the art of the present invention.

What is claimed is:

1. A virtual image control panel projecting device for a cabin for an elevator, comprising:

A projector for projecting a virtual image on a projection surface of a wall of the elevator cabin, said virtual image including at least one virtual control element recognizable by an operator, and a control sensor for sensing the activation of said virtual control element by the operator and for initiating a corresponding action by the elevator.

2. The device as recited in claim 1, wherein the projector is located in the ceiling of the elevator cabin proximate the wall upon which the virtual image is projected, and wherein the projection surface of the wall is located in the upper portion of the wall.

3. The device as recited in claim 1, wherein the projector further comprises:

a light source for generating a beam of light, a transmissive type liquid crystal display, said beam of light passing through said liquid crystal display, and a lens receiving said beam of light from said liquid crystal display, for focussing said beam onto the projection surface.

4. The device as recited in claim 3, wherein the beam of light is comprised of visual light.

5. The device as recited in claim 1, wherein the device further comprises:

a control means, including a microprocessor, for controlling the liquid crystal display to provide a plurality of separate portions within the projected image, each portion showing a different functional image.

6. The device as recited in claim 1, wherein the control sensor includes and optical detector for sensing the activation of the virtual control element by the operator.

7. The device as recited in claim 1, wherein the control sensor includes:

a touch sensitive surface, coincident with the projection surface for detecting activation of the virtual control element by touching by the operator of the portion of the projection surface corresponding to the location of the projected image of the virtual control element.

8. The device as recited in claim 7, wherein the touch sensitive surface is selected from the group of touch sensitive surfaces using resistive sensors, infared detection, or an acoustic wave plate.

9. The device as recited in claim 2, wherein the device further includes a vibration insulated mounting between the projector and the elevator cabin.

* * * * *